US005213054A

United States Patent [19]

Gallagher et al.

[11] Patent Number: 5,213,054

[45] Date of Patent: May 25, 1993

[54] EMERGENCY BULK LIQUID HANDLING SYSTEM FOR TANKVESSELS

[76] Inventors: John J. Gallagher, P.O. Box 2148, Prince Frederick, Md. 20678; Paul S. Smith, 15817 29th Dr., SE, Mill Creek, Wash. 98012

[21] Appl. No.: 880,223

[22] Filed: May 8, 1992

[51] Int. Cl.[5] ..... B63B 25/08

[52] U.S. Cl. ..... 114/74 R; 137/590; 114/172

[58] Field of Search ..... 114/72, 74 A, 74 T, 114/74 R, 227; 137/172, 578, 579, 590, 615

[56] References Cited

U.S. PATENT DOCUMENTS

| | | | |
|---|---|---|---|
| 3,859,944 | 1/1975 | Warner | 114/74 R |
| 5,086,722 | 2/1992 | Sloope et al. | 114/74 R |
| 5,095,836 | 3/1992 | Gallagher | 114/74 R |

*Primary Examiner*—Edwin L. Swinehart

*Attorney, Agent, or Firm*—Brady, O'Boyle & Gates

[57] ABSTRACT

An emergency bulk liquid handling system for tankvessels suffering damage which incapacitates their primary liquid cargo system wherein valving in the normal cargo loading drop lines, deck headers and tank walls combined with means to prime the deck headers and drop lines provides a backup cargo offloading path which bypasses the damaged system and allows movement/offloading of liquid cargo despite the otherwise incapacitating damage.

7 Claims, 5 Drawing Sheets

EMERGENCY BULK LIQUID HANDLING SYSTEM FOR TANKVESSELS

BACKGROUND OF THE INVENTION

1. Field of Invention

This invention relates to systems for handling of bulk liquid cargos in tankvessels in emergencies when cargo tanks have been flooded or when the normal cargo system has been disrupted by a casualty.

2. Description of the Prior Art

Most state of the art bulk liquid cargo carrying tankvessels are provided with cargo handling systems which include piping connecting loading midship manifolds and deck headers at one end through high capacity bottom-located cargo pumps, cargo mains and branches to "bellmouth" intakes fixed close to the bottom of each cargo tank at the other end.

Cargo is generally loaded in these vessels through the midship manifolds and deck headers to "drop lines" extending vertically from the deck headers to the bottom mains and from there, by proper alignment of valves, to the cargo tanks through branches and suction bellmouths in the bottoms of the respective tanks. In some vessels final distribution to the tanks from the drop lines to the tanks is made wholly or in part by means of sluice valves in tank bulkheads.

During normal loading, cargo is pumped "over the rail" into the deck manifolds by shoreside terminal pumps and, with the drop line valves properly aligned, flows under the influence of gravity and the shoreside pumps to charge the bottom mains for distribution directly to the cargo tanks, bypassing the vessel's cargo pumps and pumproom in the process.

During normal cargo discharge, by properly aligning the valves, one or more bellmouth intakes can be connected through the branches and bottom mains to the cargo pump system to produce suction in selected tanks for removal of cargo from those tanks to the deck headers for transfer to other tanks or ashore. The bellmouth intakes are located near the bottom of the tank and generally near the aft bulkhead thereof so that the maximum amount of cargo may be removed from the tank through high-capacity centrifugal cargo pump and large-diameter cargo piping systems. With this arrangement, by trimming the vessel by her stern, the bellmouth intake will remain immersed and capable of withdrawing cargo for the maximum length of time. Cargo remaining in the tank after this is removed by a lower capacity, positive displacement cargo stripping pumps through a smaller diameter pipe, parallel stripping system.

When a loaded tankvessel is collided with or goes aground with a hull rupture in way of her cargo tanks, seawater floods into a ruptured tank displacing the cargo in the tank as a function of the level of the highest point of damage in the hull. Where the cargo is lighter than the seawater, as the majority of liquid cargoes are, the displaced cargo, discharged to the sea as a spill, flows out rapidly at first and then gradually decreases in flow rate as the water/cargo interface approaches a natural equilibrium based on relative head between the cargo and sea. This natural equilibrium or "water bottom" is unstable, easily upset by relative motion between the vessel and the sea. Continuing spillage will normally result from wave and current action or from further movement or motion of the ship.

Another problem often encountered when a tankvessel has a casualty is that the bottom mains and/or branches of the cargo suction system are frequently disrupted by the upset or penetration of the hull so that communication between the suction intakes in the tanks and the cargo pumps in the pumproom is interrupted and normal cargo removal precluded.

If the cargo system were to be adapted to function in each tank, regardless of the flooded condition of that tank or the condition of the cargo suction system, the size of the spill could be significantly reduced since cargo could be transferred from the holed tank(s) before equilibrium is reached. It would also be of great help if the cargo in the holed tank(s) could be transferred or reduced to a degree that the resulting natural equilibrium is stabilized to prevent further spillage from the vessel caused by relative motion between the vessel and the sea. Such stabilization would also allow more radical movement of the vessel to speed her salvage and removal from further peril.

Because of the configuration of present cargo handling systems, however, the water bottom in a flooded tank will envelope the bellmouth suction intakes and/or disruption of the bottom cargo mains will preclude communication with the cargo pumps, effectively disabling the vessel's cargo pumping system in the flooded tank and/or tanks beyond the disruption. Stranded tankers have therefore been required to await the arrival of emergency "over the top" pumping equipment to have cargo in their holed tanks removed or reduced. This has resulted in the loss of all of the cargo whose discharge was required to achieve a natural interface and has involved a substantial delay in salving a casualty, prolonging the spillage of cargo and endangering the vessel and remaining cargo by delaying salvage efforts until natural equilibrium in the holed or disabled tanks is stabilized. In the EXXON VALDEZ grounding in Alaska in 1989 for example, several days passed before sufficient emergency "over the top" pumping capacity arrived and could be rigged to stabilize the several water bottoms created in that vessel by the grounding, substantially prolonging the duration (and increasing the ultimate quantity) of spillage from the vessel and the length of time she remained on her strand and vulnerable to the elements.

A device intended to accomplish similar objectives to those of the present invention is disclosed in U.S. Pat. No. 4,389,959. This device proposes a system to offload cargo from a holed vessel tank by means of an additional, independent cargo handling system fixed at a designated distance above the hull bottom and the vessel's indigenous cargo handling system. Aside from the added expense, weight and increased complexity of a system requiring an additional cargo handling system with redundant piping, cargo pump and valving, this system also introduces increased maintenance effort and increased probabilities of failure inherent in a system that would normally be used only in an emergency.

In U.S. Pat. No. 5,095,836, dated Mar. 17, 1992, emergency bulk liquid handling systems for vessels are disclosed which also address the same problem as does the present invention. These prior systems, however, either utilize the bottom mains of existing cargo systems or require the utilization of a deck-mounted main system to accomplish their purposes. Since the system would be disabled by disruption of the bottom mains in the former embodiment or would require an entirely different cargo distribution and collection system in the latter, the present invention is readily distinguishable over the systems disclosed in the above-mentioned patent.

SUMMARY OF THE INVENTION

This invention relates to an adaptation of a tankvessel liquid cargo handling system to make them operable to remove cargo regardless of the flooded condition of a cargo tank.

The invention provides a liquid cargo-carrying tankvessel cargo handling system which can adjust to provide cargo removal from flooded cargo tanks regardless of the level of interface with the water bottom formed in the tank.

The invention also provides a liquid cargo handling system which can be adjusted to allow removal of cargo when a portion of that system has been disrupted by a casualty.

The invention further provides a means for modifying cargo systems of existing tankvessels to accomplish the objective thereof which requires a minimum of additional structure and cost to achieve the modification.

In a preferred embodiment, the invention provides means incorporating existing cargo loading drop lines into the cargo discharge system to provide a means to move cargo from above a cargo/water interface in a flooded tank or from tanks beyond the point of disruption of the cargo handling system directly to deck cargo headers for discharge ashore or into other sound cargo or ballast tanks.

Other objects and specific advantages of this invention will become better understood to those skilled in the art by reference to the following detailed description when viewed in light of the accompanying drawings wherein like numbers throughout the figures thereof indicate like components and wherein:

DETAILED DESCRIPTION OF A PREFERRED EMBODIMENT

Figure 1:
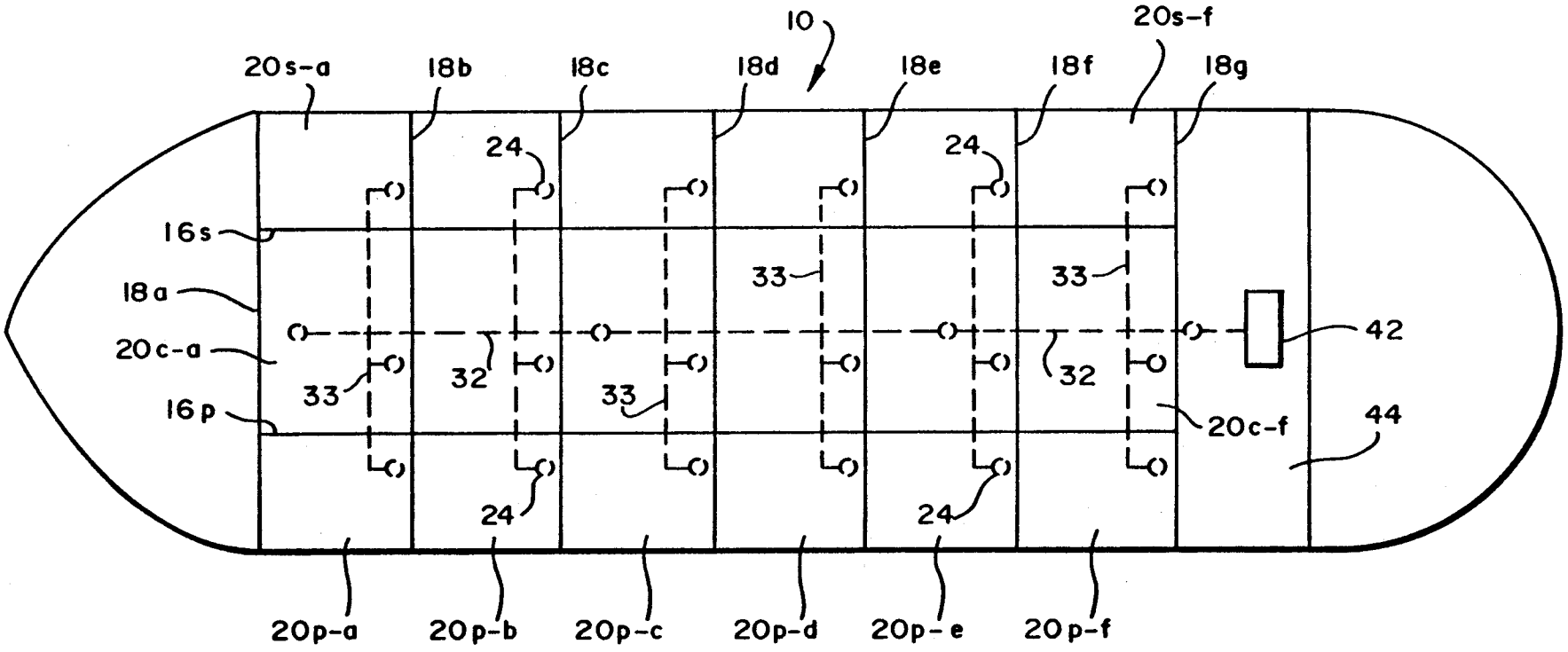
FIG. 1 is a schematic plan view illustrating the general layout of a tankvessel embodying a system in accordance with the invention.

In FIG. 1, a tankvessel, shown generally at 10, comprises hull side walls 12 and a hull bottom 14 (FIG. 2) formed in a conventional manner to make up a buoyant vessel hull structure. The hull is divided by starboard and port longitudinal bulkheads 16*s* and 16*p* respectively which intersect hull-dividing transverse bulkheads 18*a* through 18*g* to form eighteen independent cargo tanks 20*s–a, c–a* and *p–a* (starboard wing, center and port wing, row a) through 20*s–f, c–f* and *p–f* (starboard wing, center and port wing, row f) as shown. The number, layout and relative size of the cargo tanks may vary from vessel to vessel. The layout illustrated is exemplary of the arrangement common in most tankships. Deck 22 (FIG. 3) forms the tank top cover to complete the enclosure of the cargo tanks.

Figure 2:
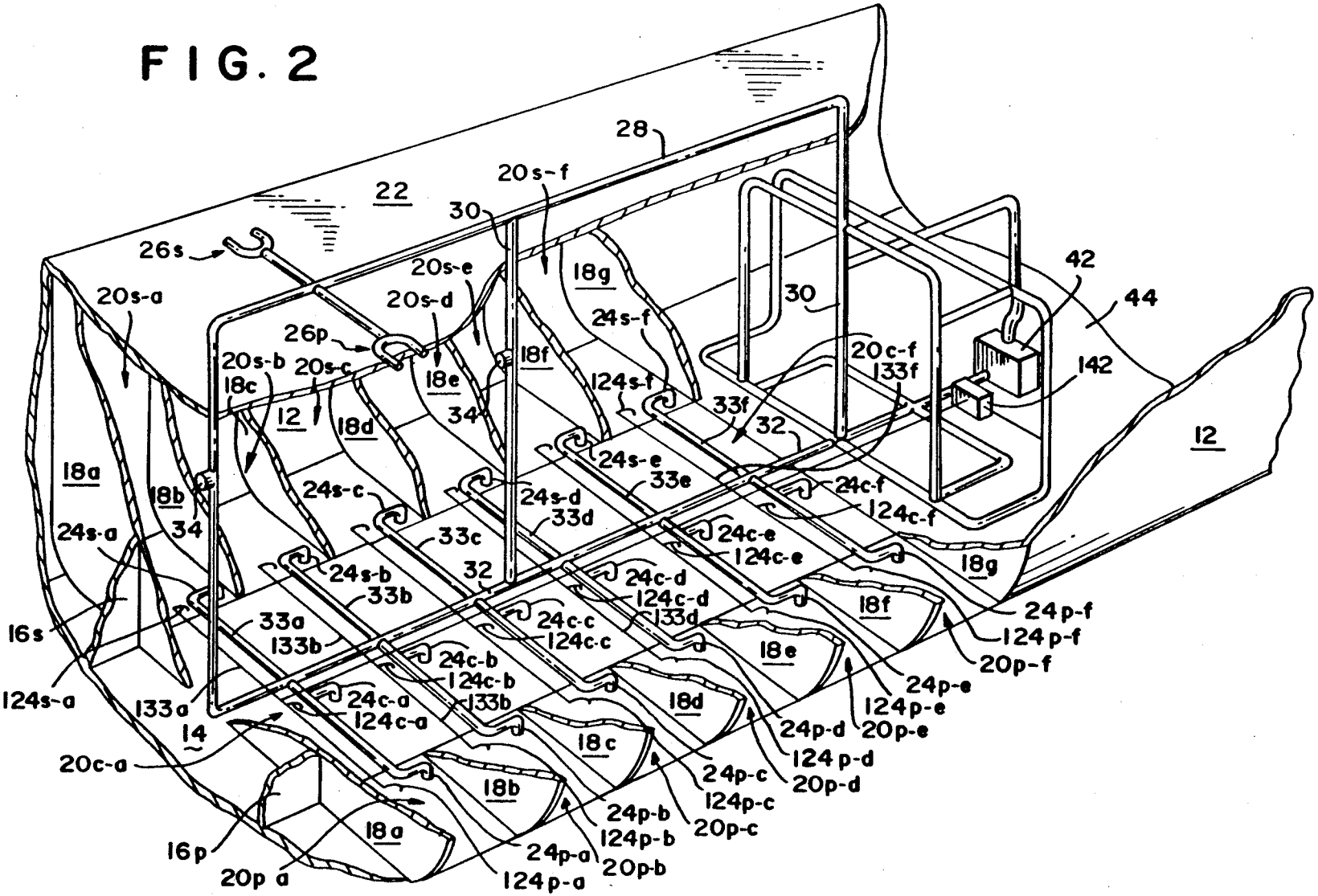
FIG. 2 is and enlarged fragmentary perspective view, partly schematic, of a portion of the tankvessel and piping system of FIG. 1.
Figure 3:
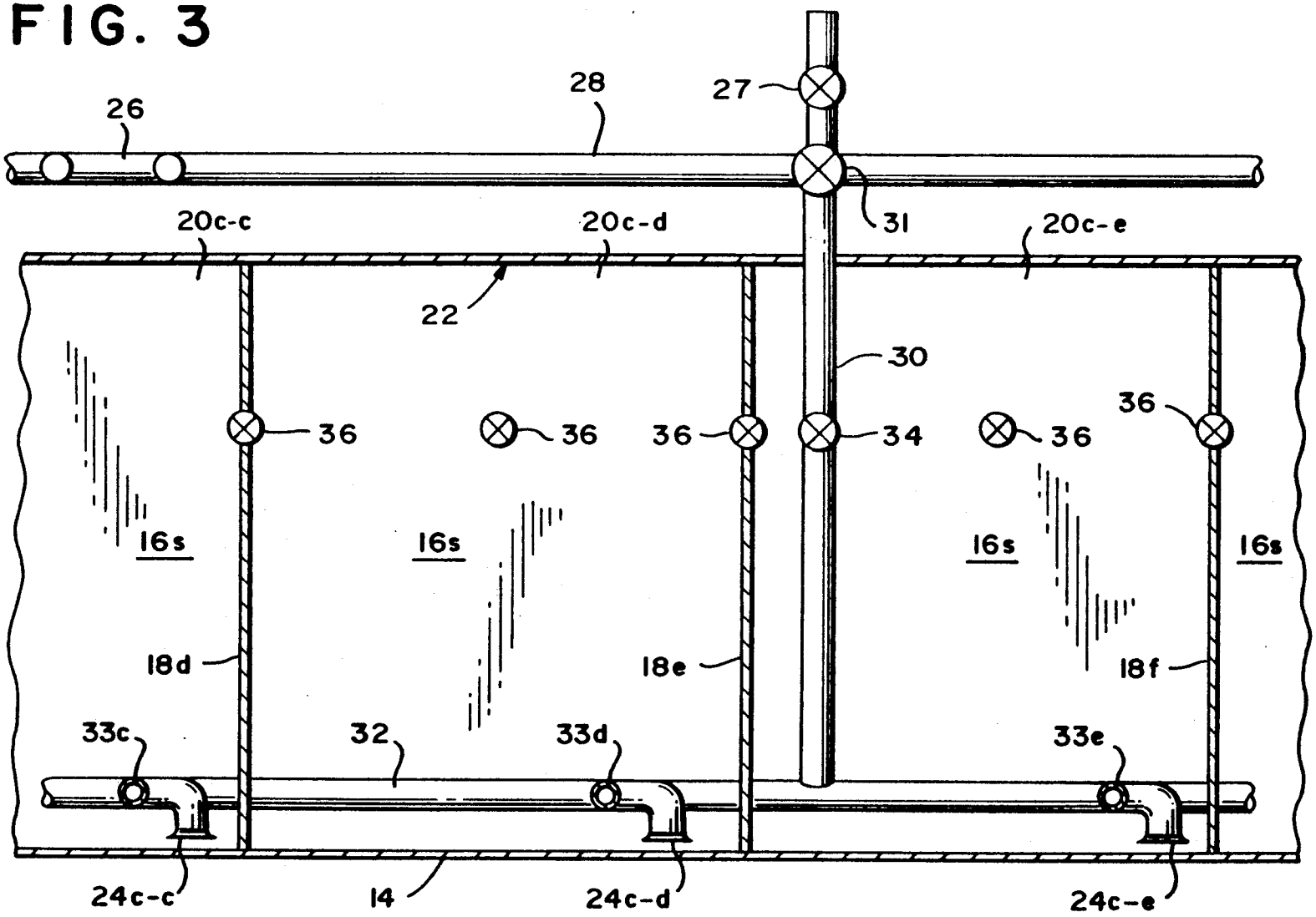
FIG. 3 is a side elevational view of a section of the tankvessel of FIG. 1 detailing elements of the invention.
Figure 4:
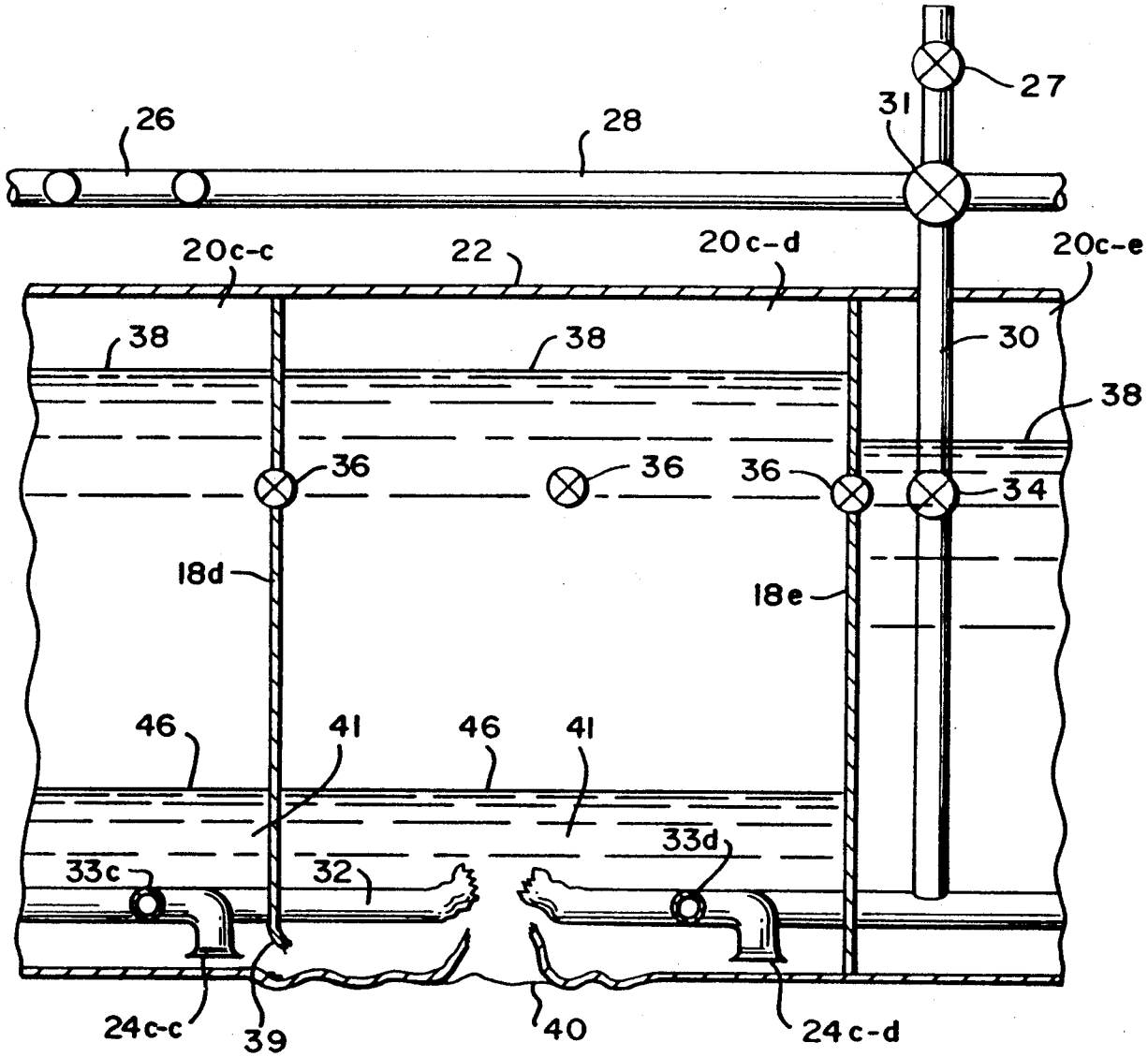
FIG. 4 is a side elevational view similar to FIG. 3 illustrating a mode of operation of the invention.

Referring now particularly to FIG. 2. details of a conventional cargo handling system are shown in a broken away perspective. The system has been simplified for clarity by omitting parallel manifolds, headers and pumps which normally serve the conventional tankvessel. The system illustrated comprises conventional cargo transfer midship manifolds 26 selectively communicative by valving (not shown) through a deck header 28 with a central cargo pump 42 located in a pump room 44 immediately aft of cargo tank 20*c–f*. The cargo pump, in turn, is selectively communicative through a bottom cargo main 32 and valved branches 33 with suction intakes 24 in each of the cargo tanks. The conventional cargo handling system further includes drop lines 30 connecting the deck header 28 directly to the bottom cargo main 32 to provide means to selectively bypass pump 42 during cargo loading. The drop lines are selectively isolated from the cargo system by header/drop line valves 31 as shown in FIG. 3 and 4. The pump 42, cargo main 32, branches 33 and suction intakes 24 are horizontally situated at a level proximate the hull bottom 14 (FIG. 2) to minimize lift problems with cargo in the bottoms of the tanks.

Referring again to FIG. 1, the manifolding of the cargo handling system comprises the cargo main 32 extending longitudinally from the pump room 44 forward through the center tanks to center tank 20 *c–a*. Branches 33 connected to the cargo main, extend transversely to the port and starboard at the aft end of each center tank to provide communication to suction intakes 24 located at the aft end of the respective center and port and starboard wing tanks. Valving (not shown) in each branch 33 provides selective communication between the tanks, the main 32 and ultimately the cargo pump 42. Mechanical valve actuators situated on the deck above each valve (not shown) may be linked to each valve for operation thereof and/or motor-operated valves with remote operation from a control room may be provided as desired for selective opening and closure of the valves. The details of the cargo handling system described thus far are conventional and well understood by those skilled in- the art. Since they do not constitute the inventive concept involved in this invention, they are not further described or shown in greater detail herein.

Because the cargo pumping system generally incorporates high capacity centrifugal cargo pumps and large-diameter mains and branches, residual cargo is invariably left in the cargo tanks when the quantity therein is insufficient to allow the cargo pumps to maintain suction. For this reason, most tankvessels are equipped with a stripping system which parallels the cargo collection system with smaller diameter piping and positive-displacement, lower capacity stripping pumps to allow the cargo remaining on board after the main cargo pumps have finished to be pumped ashore. The stripping system is shown in line schematic in FIG. 2 with parts of the stripping system corresponding to the equivalent parts in the cargo system indicated by like numbers of the next higher order.

There are also many ancillary structures and systems forming necessary parts of modern tankvessels which, for the purposes of clarity, have also been omitted since they do no constitute part of the inventive concept of this invention. These omitted elements include stiffeners, stringers, web frames and other structural details; inert gas systems, and crude oil washing systems; accommodation, engine room and pump room spaces; and non-cargo carrying tanks such as fore-peak tanks and dedicated ballast tanks and the like.

The number and location of drop lines may vary from tankvessel to tankvessel and, in some cases, the drop lines, rather than connect to a bottom cargo main, will discharge directly into a tank for sluicing to adjacent tanks when sluicing is employed for distribution and collection of cargo.

The structure which has been described thus far is conventional and exists in one form or another in almost all modern tankvessels carrying bulk liquid cargoes. Some vessels will "spine load" with mains to the center tanks and, through sluice valves in the longitudinal bulkheads, provide communication between the respective center and wing tanks while a few depend entirely on sluice valves through both longitudinal and transverse bulkheads to provide commonalty between all cargo tanks or selected banks of tanks to the after tanks which the connect to the pump system.

Referring now to FIG. 3, the structure of FIG. 1 and FIG. 2 is shown in enlarged detail in center tank 20*c–d* to illustrate the elements of this invention. A high suction valve 34 is provided in each of the drop lines 30 intermediate the deck 22 and the hull bottom 14 to provide communication between cargo tank 20*c–d* and the cargo system at that point. The valve 34 may be of any conventional three-way type known in the art to open communication at the high suction point to the cargo tank 20*c–d* while blocking flow down or up the drop line below that point. It preferably comprises a set of stacked valves with a check valve, providing one-way communication from the tank into the drop line, on top of a gate valve which selectively provides communication from the headers down the drop line in a normal cargo loading configuration or, in an emergency, blocks communication with the lower end of the drop line. The valve 34 may be located vertically at any point above the maximum static lift for suction by the cargo pumps from the deck header (on the order of 20 to 25 feet depending on cargo and atmospheric pressure) and below the tank tops but is preferably located at or near the level of the summer load line of the vessel. Should a variable suction level be required by cargo or trading pattern requirements, multiple suction valves at appropriate levels or a valve system with variable intake level to follow the cargo level, as will be described below, can be incorporated in the drop lines.

A bleeder valve 27, located in the header 28 above the forward wall of the drop line 30, provides a means to bleed air/vapor from the header and drop line during priming of the drop line as will be described below. The bleeder valve is preferably connected to the vessel's high velocity vent system (not shown). The header/-drop line valve 31 is preferably a three way valve of a type known in the art which can selectively provide: (1) straight-through communication, bypassing the drop line; (2) manifold-to-header-to drop line communication, blocking communication to the cargo pump aft of the drop line; or (3) drop line-to-header-to-cargo pump communication, blocking communication to the manifold forward of the drop line.

Since the drop lines 30 will normally be located in selected or what might be deemed "core" cargo tanks, this invention provides high sluice valves 36 in the longitudinal bulkheads 16*s* and 16*p* and transverse bulkheads 18*d*, 18*e* and 18*f* as shown to provide selective communication between the core cargo tank 20*c–e* and the cargo tanks adjacent thereto and between those tanks and the tanks next adjacent thereto and so on. Depending on the location and number of drop lines, much as is presently done with cargo distribution and collection in existing sluice systems, remote tanks can be cascaded to the core tank by means of the sluice valves through tanks adjacent to the core cargo tank in which the drop line is positioned. This would occur in FIG. 3, for example, with cargo tank 20*c–c* which could be cascaded through tank 20*c–d* to flow into tank 20*c–e*. Again, the vertical level of the valves 36 may be at any point above the maximum static head and the tank tops as discussed above but is preferably at or near the level of the suction valves 34. As also discussed above, should a variable suction level in the drop lines be desired, multiple sluice valves can be provided at graduated levels through the bulkheads.

Some or all of the sluice valves 36 can be eliminated, if desired, by adding additional drop lines in some or all of the other cargo tanks to reduce the need for sluicing or cascading between tanks.

The operation of the invention is illustrated in FIG. 4. In that Figure, the tankvessel is loaded with an oil cargo 38 as shown in each of the tanks. Tank 20*c–d* has been holed by a casualty at 40 upsetting the hull bottom 14, severing the cargo main 32 and breaching the transverse bulkhead 18*d* at 39 to make cargo tanks 20*c—c* and 20*c–d* common. Seawater 41 has entered tank 20*c–d* and, through the breach 39, tank 20*c—c*, displacing a portion of the oil cargo in both tanks and forming a water bottom with an oil/water interface at 46. A portion of the displace cargo will be discharged to the sea and, due to the normal specific gravity less than 1.0 of petroleums, a portion will be displaced upwardly to decrease the ullage in the holed tanks over the sound tanks as shown.

The level of the oil/water interface is a function of the level of the highest penetration of the hull. The natural interface will be somewhat above the damage level since the action of waves, current and the motion of the ship, if any, will result in discharge of cargo above that point. An interface two or three feet above the highest point of damage would be expected in all but the quietist of waters. For damage such as that illustrated, water will flow in and displaced oil will flow out until a natural equilibrium interface based on relative motion between the water and the ship as described above. The greater the relative motion, the higher the natural equilibrium interface and the greater the resulting water bottom in the tank. The problem with the natural interface is that it is unstable and will continue to be upset by relative motion between the water and the vessel or any change in trim of the ship raising the draft of the ship in the area of the holed tank. This instability will lead to continued displacement of the cargo by water and a continuing resulting spill if there are currents, seaway, movement of the ship or adverse changes in trim of the ship. Salvage efforts are therefor severely restricted until the interface can be stabilized if further oil spillage is to be minimized.

In the case of EXXON VALDEZ ample extra tankage was immediately available in the form of other tankers and barges but transfer from the damage tanks had to await the arrival of emergency "over the top"

pumping resources in the form of high capacity hydraulically driven submersible pumps by air-lift from the lower 48 states. Sufficient slack tankage was available on board EXXON VALDEZ to accommodate enough of the cargo from damaged tanks to stabilize the oil water interface immediately, however, her cargo-handling system was disabled in those tanks because the water bottoms therein immersed the bellmouth intakes.

Because she went aground at mid tide on a flooding tide and the tidal range was about 12 feet at Bleigh Reef that day, EXXON VALDEZ lost an additional six feet of cargo from her holed tanks on the falling tide because of the inability to move her cargo quickly. This may easily have doubled the size of the resulting spill of about 11 million gallons.

As can be seen from the normal cargo working positions of the bellmouths 24, the oil/water interface in cargo tanks 20*c*—*c* and 20*c*–*d* will be above the suction inlets (24*c*—*c* and 25*c*–*d*) in those tanks thereby precluding withdrawal of cargo through the normal cargo system, even where communication with the cargo pump is intact as in tank 20*c*–*d* since water will continue to flow into the tanks through the holes to replace water removed by the pump. Where communication to the cargo pump have been interrupted by the break in the main as in tank 20*c*–*d*, removal of cargo from that tank through the normal cargo system would be impossible even if the tank were whole and no water bottom was present since pump communication is non existent.

With the casualty in the above condition, cargo can be removed with ship's equipment in the present invention by reconfiguring the cargo system as follows:

The gate valve portion of valve 34 in drop line 30 is actuated to close communication with the cargo 38 in tank 20*c*–*e* through the lower portion of that drop line. Sluice valves 36 in transverse bulkheads 18*d* and 18*e* are then opened to make tanks 20*c*—*c*, 20*c*–*d* and 20*c*–*e* common.

Utilizing the stripping system described above and shown in FIG. 2, cargo is transmitted from one of the sound cargo tanks through the stripping pump 142 into the deck header. Returning to FIG. 4, with the header/-drop line valve 31 configured to provide communication exclusively between the drop line and cargo pump, cargo from the stripping pump will charge the drop line to the level of the valve 34 in the tank 26*c*–*e* thereby priming the header/drop line piping between the valve 34 in tank 20*c*–*e* and the cargo pump 42. By opening the bleed valve 27 in the header 28 above the drop line 30 in tank 20*c*–*e* during priming, air/vapor trapped in the lines can be bled off during the priming process, providing a full liquid prime between the pump and the valve 34.

With the system primed, by then drawing down on the cargo in that tank with the cargo pump through the deck header 28 and drop line 30, cargo will be moved from tank 20*c*–*e* through the check valve portion of the valve 34 since the static lift is not above the capability of the pump and the line between the cargo pump and the oil cargo 38 has been primed as is necessary with centrifugal pumps. With removal of cargo from tank 20*c*–*e*, cargo from tanks 20*c*–*d* and 20*c*—*c* will flow in to replace the cargo removed effectively raising the level of the interface 46 in those tanks, stabilizing them. Cargo removed from tank 20*c*–*e* can be transferred to slack tanks, slop tanks or over the side to lightering vessels if they are available. To maintain hydraulic balance, the holed tanks will naturally contribute to the makeup of cargo in tank 20*c*–*e*, tank 20*c*–*d* by direct transfer through the valve 36 in bulkhead 18*a* and tank 20*c*—*c* by cascading cargo into tank 20*c*–*d* through the valve 36 in bulkhead 18*d*.

As cargo is removed from tanks 20*c*—*c* and 20*c*–*d*, the water bottoms in those tanks will increase to continue to push the level of the cargo up for continued flow through the valves 36 until the level of the water bottoms with the weight of the oil remaining on top reaches equilibrium with the waterline of the vessel.

As sufficient tankage becomes available, the remaining cargo in the tanks can be removed continuing to raise the interface until all removable oil is out of the holed tanks. In an emergency, should insufficient slack tankage be available, the vessel could rig to transfer cargo to her dedicated ballast tanks or sufficient slack tankage to allow stabilization of holed tanks could be mandated.

Figure 5:
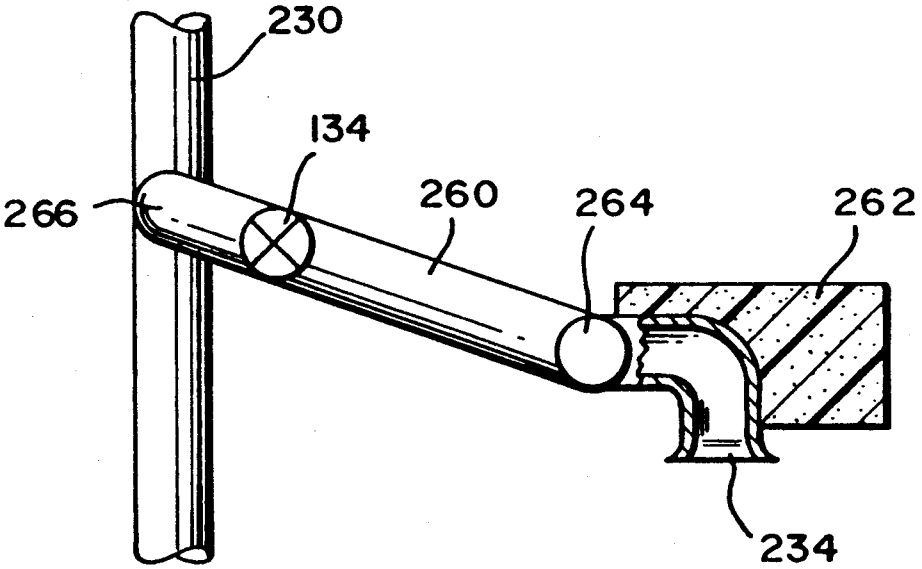
FIG. 5 is a variation of a portion of the invention of FIG. 3 wherein like components thereof are indicated by like numbers of the next higher order.

As was indicated above, means may be provided to vary the level of the intake to accomplish removal of all or most all of the cargo remaining on the water bottom under certain conditions. FIG. 5 illustrates one such means in the form of an arm 260 pivotally connected and communicative with the drop line 230 through a swivel joint 266 in a manner known in the art. Valve means 134 in the arm provides for selective communication to the drop line. A second swivel joint 264 communicatively connects a high suction inlet 234 to the arm 260. Flotation 262, preferably a foam-filled tank or the like, furnishes flotation for the inlet and arm assembly such that it will follow the surface level of the liquid within the tank to function as a skimmer of sorts for removal of remaining quantities of cargo as necessary. For removal of smaller quantities of cargo, the stripping pump system described above could be substituted for the cargo pump system.

Figure 6:
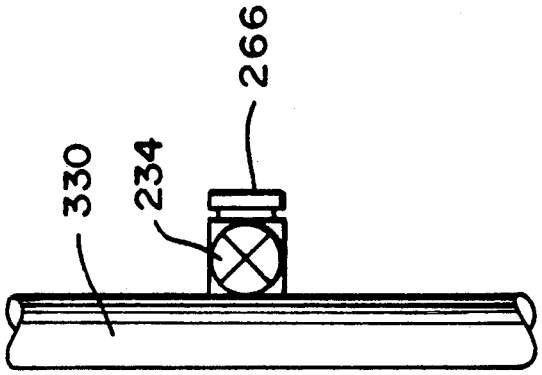
FIG. 6 is a view similar to FIG. 5 illustrating another variation of the invention shown in FIG. 3 where like components are indicated by like numbers of the next higher order.

It should be obvious that the arm 260 could be rigid in construction or be comprised of a flexible suction hose or the like. In the latter configuration, swivels 264 and 266 would not be necessary. This means could also simply comprise a valved quick connection 266 (FIG. 6) which could receive a skimmer hose or arm to be manually connected to the drop line 330 should an emergency require it. The necessary skimming equipment to accomplish this would be maintained on board as part of the spill response equipment kit now required by law.

From the aforegoing, it should be obvious that various alternative mechanical structures could be substituted to achieve the ends of this invention. It should be therefore understood that the invention may be practiced other than as specifically described.

What is new and therefore desired to be protected by Letters Patent of the United States is:

1. In a vessel having a hull deck and bulkheads defining side, top and bottom walls of a plurality of liquid cargo-carrying tanks therein and cargo-handling means including pump means, cargo collection means comprising bottom mains and branches connecting said pump means to suction intake means in at least one of said tanks and cargo loading/discharge means including at least one deck manifold and deck header connected to said pump means, the improvement comprising at least one vertical drop line selectively communicating said cargo loading means with the bottom of at least one of said cargo-carrying tanks to bypass said pump means for loading cargo directly into said tanks, high suction valve means in said drop lines for selectively providing high suction inlets for said cargo-carrying tanks in which said drop lines are situated, and means to prime said headers and said drop lines to provide for continued removal of cargo from said tanks by said pump means through said drop lines in the event of tank flooding or disruption of said cargo collecting means.

2. Means in accordance with claim 1 further comprising sluice valve means situated in the bulkheads between said cargo-carrying tanks at a level proximate that of said high suction valve means to selectively provide communication between said cargo-carrying tanks and said high suction valve means.

3. Means in accordance with claim 2 wherein plural drop lines are positioned in selected core tanks among said cargo-carrying tanks and wherein said sluice valve means selectively provide communication between said cargo-carrying tanks and at least the most proximate of said core tanks.

4. Means in accordance with claim 1 wherein said means to prime said headers and said drop lines includes a bleeder valve located in the top of said headers directly above each of said drop lines to selectively bleed air and vapor from said header and said drop lines during the priming process.

5. Means in accordance with claim 4 wherein said means to prime said headers and said drop lines further includes a block valve in said drop lines below said high suction valve means to selectively block communication between said header and the lower portion of said drop lines and hold the prime between said high suction valve means and said pump means.

6. Means in accordance with claim 4 wherein said means to prime said headers and said drop lines further includes a block valve in said headers forward of said headers valve means to selectively block communication between said cargo pumps means and the portion of said header forward of said drop lines to confine the prime to the portion of said header and said drop lines between said high suction valve means and said pump means.

7. Means in accordance with claim 4 wherein said pump means comprises cargo pump means for moving cargo at a high rate and parallel stripping pump means for moving cargo at a reduced rate and wherein said means to prime further includes said stripping pump means.

* * * * *